US006939115B2

(12) United States Patent
Knoll et al.

(10) Patent No.: US 6,939,115 B2
(45) Date of Patent: Sep. 6, 2005

(54) WET-TYPE ROTOR PUMP

(75) Inventors: Andreas Knoll, Dortmund (DE); Michael Weinert, Leisnig (DE)

(73) Assignee: Pierburg GmbH, Neuss (DE)

( * ) Notice: Subject to any disclaimer, the term of this patent is extended or adjusted under 35 U.S.C. 154(b) by 39 days.

(21) Appl. No.: 10/211,963

(22) Filed: Aug. 2, 2002

(65) Prior Publication Data

US 2003/0035740 A1 Feb. 20, 2003

(30) Foreign Application Priority Data

Aug. 18, 2001 (DE) ..... 101 40 613

(51) Int. Cl.[7] ..... F04B 17/04
(52) U.S. Cl. ..... 417/423.12; 417/423.13
(58) Field of Search ..... 417/366, 369, 417/370, 365, 423.1, 423.12, 423.13, 424.1; 384/368, 420

(56) References Cited

U.S. PATENT DOCUMENTS 2,799,227 A * 7/1957 Allen ..... 103/87
3,090,655 A * 5/1963 Dilworth ..... 384/129
3,114,323 A * 12/1963 Moser ..... 103/87
3,186,513 A * 6/1965 Dunn et al. ..... 184/1
3,936,243 A * 2/1976 Gakenholz ..... 417/423.3
4,772,188 A * 9/1988 Kimura et al. ..... 418/55
5,039,286 A * 8/1991 Point et al. ..... 417/424.1
5,785,013 A 7/1998 Sinn et al. ..... 123/41.44
5,796,349 A * 8/1998 Klein ..... 340/682
6,095,770 A * 8/2000 Obata et al. ..... 417/420
6,309,188 B1 * 10/2001 Danner ..... 417/366
6,663,362 B1 * 12/2003 Lentz et al. ..... 417/423.7

FOREIGN PATENT DOCUMENTS

JP 357073892 A * 5/1982
JP 360234120 A * 11/1985

* cited by examiner

*Primary Examiner*—Charles G. Freay
(74) *Attorney, Agent, or Firm*—Ohlandt, Greeley Ruggiero & Perle, L.L.P.

(57) ABSTRACT

A wet-type rotor pump which is particularly suitable for feeding coolant in motorcar engines comprises a pump wheel. By the pump wheel, a feed medium is fed through an intake channel into a discharge channel. Via a common shaft, a motor armature of an electric motor is connected with the pump wheel. The motor armature is surrounded by a slit pot, feed medium flowing around the motor armature to cool it. The shaft is supported by two radial bearings, one radial bearing being arranged in a supporting element. The supporting element that is arranged within the intake channel further comprises an abutting surface on which a flow surface of the pump wheel abuts to take up axial forces.

8 Claims, 2 Drawing Sheets

WET-TYPE ROTOR PUMP

TECHNICAL FIELD

The invention relates to a wet-type rotor pump, i.e., a pump-motor unit consisting of, for example, a centrifugal pump and an electric d.c. motor. Such wet-type rotor pumps are particularly suitable for feeding coolant in motorcar engines.

BACKGROUND OF THE INVENTION

From German Patent 195 45 561, a wet-type rotor pump with a pump wheel is known which takes in a feed medium through an intake channel and feeds it towards a discharge channel. The pump wheel is mounted on a shaft. A motor armature of a motor is mounted on the same shaft. The feed medium flowing around the motor armature is used to cool the motor and possibly provided electronic components. For feeding electrically conductive liquids, the motor armature is surrounded by a slit pot. The stator package of the motor with the windings is arranged outside the slit pot preferably consisting of plastics. By means of the slit pot through which a gap is formed between the motor armature and the inside of the pot, in which gap feed medium is able to flow, a sealing of the motor armature with respect to the environment is guaranteed. Wet-type rotor pumps utilized for feeding electrically non-conductive liquids such as gasoline have no slit pot since no sealing with respect to the stator package and the windings is required.

The common shaft supporting the motor armature and the pump wheel is supported by two radial bearings, one in the region of the pump wheel and one at the opposite end of the shaft in the slit pot or in a housing. Due to the pressure differences in the feed medium, axial forces occur. Additionally, the motor transfers axial forces to the shaft due to the magnetic forces. For the axial support, it is known to mount an axial bearing to the rotor, which is supported on a bearing seat inserted in the slit pot. In wet-type rotor pumps, only sliding bearings can be used both as radial and as axial bearings since the service life of ball and roller bearings within liquids is too short. The provision of an axial bearing between slit pot and rotor makes the assembly of the wet-type rotor pump more complicated.

OBJECT OF THE INVENTION

It is the object of the present invention to simplify the axial bearing of the shaft of a wet-type rotor pump and to make the mounting easier.

This object is solved, according to the invention, with a wet-type rotor pump having a pump wheel downstream of an intake channel in feed direction, a motor armature connected with the pump wheel via a common shaft, a slit pot surrounding the motor armature, feed medium flowing around the motor armature for cooling, and at least one radial bearing, wherein a supporting element provided in the intake channel and comprising an abutting surface on which a flow surface of the pump wheel abuts to take up axial forces.

According to the invention, the wet-type rotor pump comprises a supporting element provided in the intake channel. The supporting element upstream of the pump wheel in flow direction serves to take up axial forces. To this end, the supporting element comprises an abutting surface on which a flow surface of the pump wheel abuts. Thus, the axial bearing according to the invention comprises only one abutting surface since it has been noticed that the axial forces occurring in wet-type rotor pumps only act against the flow direction of the feed medium because of the pressure difference between the intake channel and the room arranged behind the pump wheel, i.e., in the region of the motor armature. Thus, one abutting surface to take up axial forces is sufficient. The axial forces evoked due to magnetic forces by the electric motor are oriented into the same direction upon mounting the motor.

By providing a supporting element in the intake channel, the mounting of the wet-type rotor pump is considerably simplified, since, upon assembly of the pump, the flow surface of the pump wheel automatically abuts on the abutting surface of the supporting element and thus, the axial bearing of the shaft is guaranteed. A separate installation of an additional axial bearing is not required. Therefore, no additional bearing seat is required.

As a further improvement of the mountability of the wet-type rotor pump, the supporting element bears a radial bearing of the shaft. Preferably, the supporting element has a cylindrical opening therefor in which a radial bearing is provided. In wet-type rotor pumps, sliding bearings are preferably used, therefore, the radial bearing preferably is a bearing sleeve inserted into the opening of the supporting element. Upon assembly, the shaft on which the pump wheel is preassembled is inserted into the opening of the supporting element. At the same time, the shaft is axially supported, since the flow surface of the pump wheel is brought into abutment on the abutting surface of the supporting element when the shaft is inserted. In this manner, the pump shaft has been borne radially and axially at the same time within one assembly step.

BRIEF DESCRIPTION OF THE DRAWINGS

Hereinafter, the invention is explained in detail with reference to a preferred embodiment thereof with respect to the accompanying drawings, in which.

DETAILED DESCRIPTION

Figure 1:
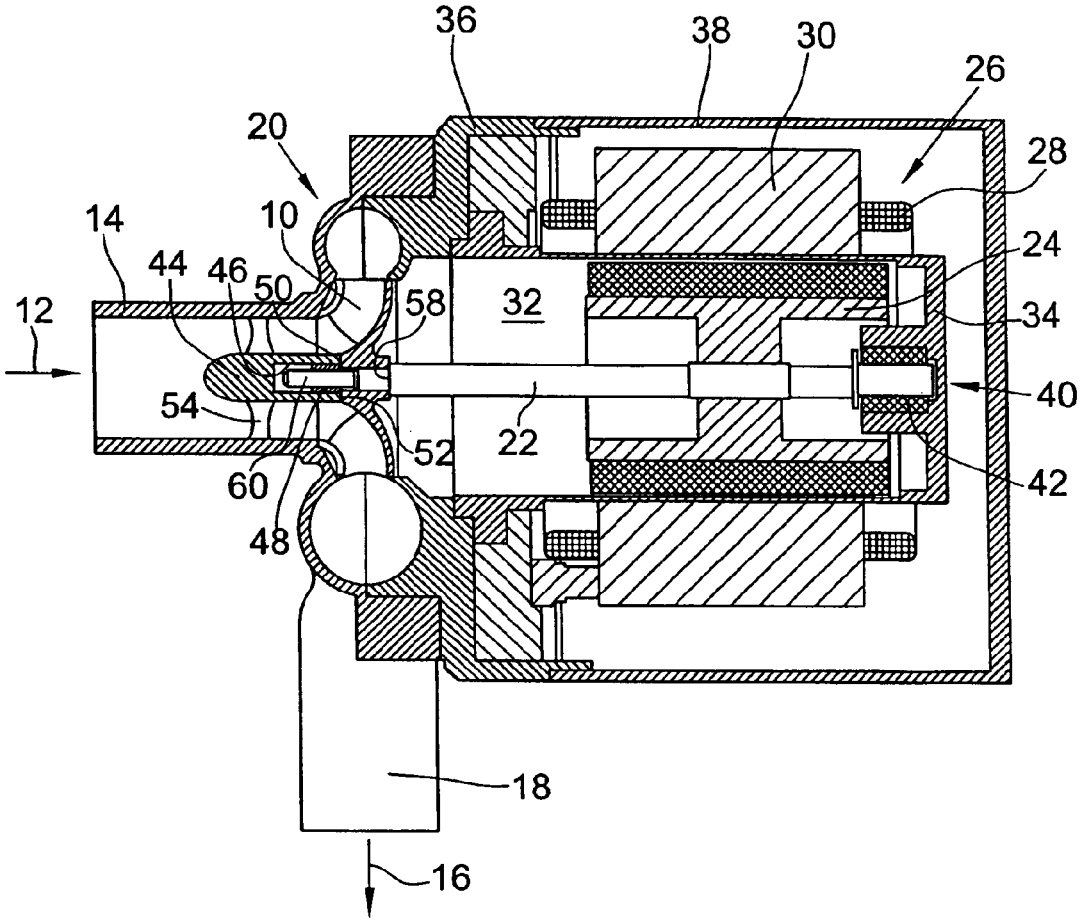
FIG. 1 is a general schematic cross-sectional view of a wet-type rotor pump according to the invention.

The wet-type rotor pump comprises a pump wheel 10 by the rotation of which medium is drawn in the direction of an arrow 12 through an intake channel 14 and fed through a discharge channel 18 in the direction of an arrow 16. The intake channel 14 and the discharge channel 18 form part of a pump lid 20 in which the pump wheel 10 is arranged. The pump wheel 10 is fixedly connected to a shaft 22.

A motor armature 24 of a motor 26 is fixedly connected to the shaft 22 to drive the pump wheel. The motor armature 24 is surrounded by a stator package 30 comprising windings 28. Relative to the motor armature or rotor 24, the stator package 30 is axially displaced to the left in FIG. 1, so that the magnetic axial traction acts in the same direction as the hydraulic axial traction.

The medium fed by the pump wheel 10 serves to cool the motor 26. To this end, the medium reaches a rotor chamber 32 behind the pump wheel 10 in feed direction 12. When electrically conductive liquid is fed, it must be avoided that the windings 28 or other electronic components come into contact with the feed medium. Therefor, the motor armature 24 is surrounded by a slit pot 34. Through the slit pot 34, a narrow gap is configured between the motor armature 24 and an inner side of the slit pot 34. The slit pot 34 is connected to one housing half 36 and sealed with respect thereto. The slit pot 34 and the housing half 36 may form a unit as well. A second housing half 38 is connected with the first housing half 36 and encloses the motor 26.

The shaft 22 is borne in a first radial bearing 40 comprising a bearing sleeve 42 held in the slit pot 34. According to the invention, the opposite shaft end to which the pump wheel 10 is mounted is borne in a supporting element 44. Therefor, the supporting element comprises an opening 46. The opening 46 is cylindrical and coaxial to the shaft 22. In the opening 46, a bearing sleeve 48 is arranged by means of which a sliding bearing is configured in the supporting element 44.

According to the invention, the shaft 22 is axially borne by the abutting surface 50 provided on the supporting element 44 and extending substantially radially to the shaft 22. The abutting surface 50 is a circular ring surrounding the opening 46. A flow surface 52 of the pump wheel 10, i.e., a surface pointing toward the intake channel 14 in opposite direction to the flow direction 12, abuts on the abutting surface 50. Since the occurring axial forces are directed against the flow direction 12 because of the pressure difference between intake channel 14 and rotor chamber 32, it is sufficient to provide an abutting surface 50 as an axial bearing on the supporting element. Axial forces directed in the other direction, i.e. to the right in FIG. 1, do not occur. Also the axial forces caused by the motor 26 point to the left in FIG. 1 are smaller than the axial forces occurring because of the pressure difference.

Figure 2:
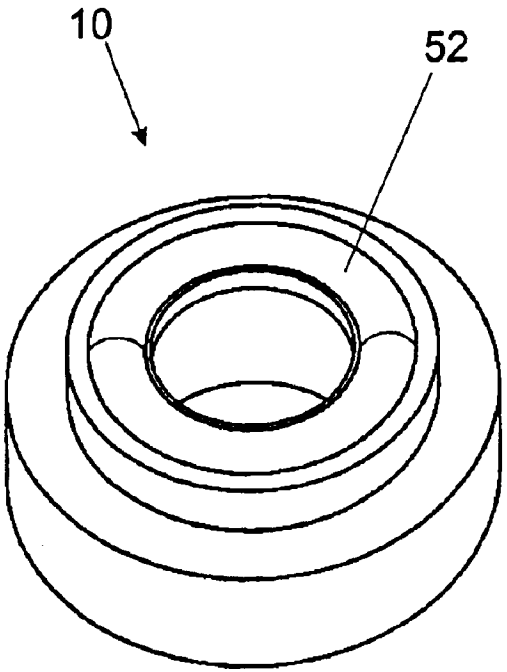
FIGS. 2–4 show preferred embodiments of a flow surface.
Figure 3:
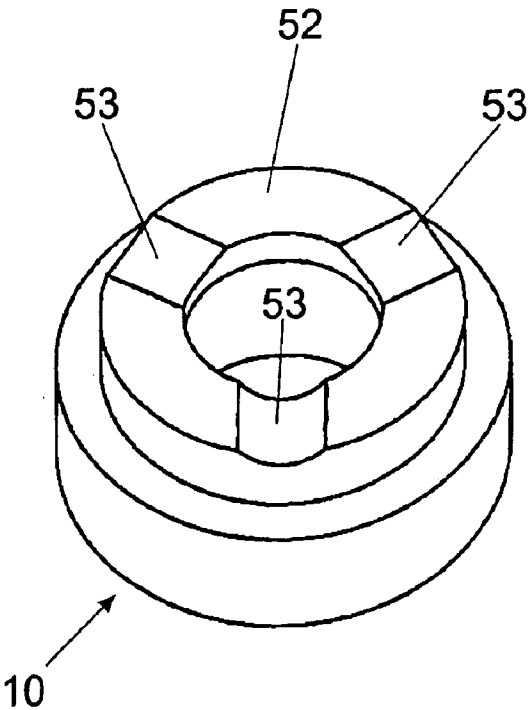
Figure 4:
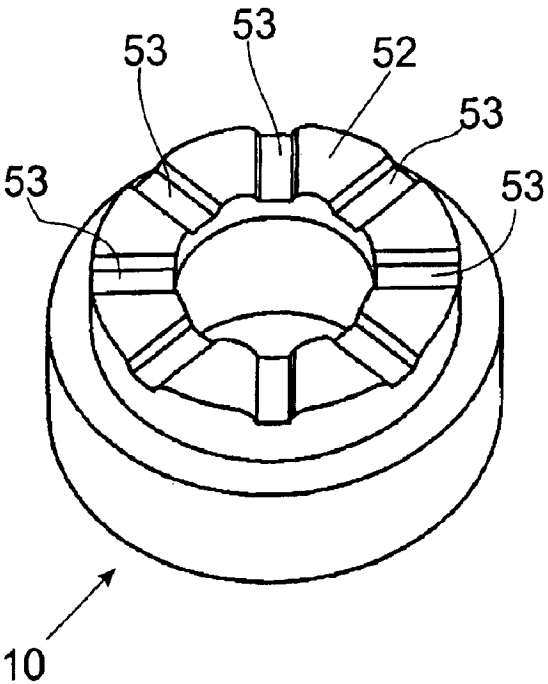

The flow surface 52 preferably has a convex configuration (FIG. 2), but can also be supplemented by geometric features such as grooves 53 and the like (FIGS. 3,4), which further an improved wetting of the contact surface between abutting surface 50 and flow surface 52, and contacts a radially extending plane abutting surface 50. The abutting surface 50 may have a concave configuration so that an additional radial orientation of the pump wheel 10 is effected. The configurations of flow surface 52 and abutting surface 50 may also be vice versa.

The supporting element 44 is connected with the intake tube 14 via webs 54. Preferably, the periphery of the supporting element that is rotationally symmetrical to the central axis of the shaft 22 is provided with three webs 54. The outer contour of the supporting element 44 is preferably streamlined so that the medium flowing in the direction of the arrow 12 is directed onto the pump wheel 10 by the supporting element.

In the illustrated embodiment, that side of the supporting element onto which the flow is directed has the cross-sectional shape of a section of an ellipse. Upon assembly, the rotor 24 and the pump wheel 10 are pushed onto the shaft 22 first. Splines (not shown) or the like may be provided for fixing. The pump wheel 10 is pushed onto the shaft 22 until it abuts on a shoulder 58. Subsequently, the shaft end 60 of the shaft 22 is inserted into the bearing sleeve 48 arranged in the supporting element 44. After the shaft 22 has been inserted into the sleeve 48, the flow surface 52 of the pump wheel 10 abuts on the abutting surface 50 of the supporting element 44. Due to the fact that the shaft 22 is borne in the region of the pump wheel 10, a very precise positioning of the pump wheel 10 in the pump lid 20 is possible. Since, according to the invention, the supporting element 44 is connected with the intake channel 14 via webs 54, the position of the opening 46 relative to the pump lid 20 is defined. Thus, the position of the pump wheel 10 relative to the pump lid 20 is clearly defined. Thereby, a minimum leakage gap between the pump wheel 10 and the pump lid 20 is guaranteed. Because of this positioning of the bearing seat at the shaft end 60, a greater balance error of the pump wheel 10, too, can be tolerated in particular.

What is claimed is:

1. A wet-type rotor pump comprising:

a pump wheel downstream of an intake channel in a feed direction, a motor armature connected to the pump wheel via a common shaft, a slit pot surrounding the motor armature, feed medium flowing around the motor armature for cooling, and at least one radial bearing, wherein a supporting element is provided in the intake channel and comprises an abutting surface on which a flow surface of the pump wheel abuts to take up axial forces.

2. The wet-type rotor pump according to claim 1, wherein said abutting surface and/or the flow surface extends radially to the shaft.

3. The wet-type rotor pump according to claim 1, wherein said abutting surface or the flow surface is convex.

4. The wet-type rotor pump according to claim 1, wherein said abutting surface or the flow surface comprise geometric features, thereby improving the lubrication of the contact surface.

5. The wet-type rotor pump according to claim 1, wherein said supporting element is connected with the intake channel via webs.

6. A wet-type rotor pump comprising:

a pump wheel downstream of an intake channel in a feed direction, a motor armature connected to the pump wheel via a common shaft, a slit pot surrounding the motor armature, feed medium flowing around the motor armature for cooling, and at least one radial bearing, wherein a supporting element is provided in the intake channel and comprises an abutting surface on which a flow surface of the pump wheel abuts to take up axial forces, and wherein said supporting element supports a radial bearing of the shaft.

7. A wet-type rotor pump comprising:

an intake channel for a medium;

a pump wheel in said intake channel;

a supporting element in said intake channel upstream of said pump wheel such that a flow direction of said medium is defined between said intake channel and said supporting element; and a radial bearing in said supporting element, wherein said pump wheel has a flow surface facing said flow direction and said supporting element has an abutting surface facing opposite said flow direction, said flow surface abutting said abutting surface to take up axial forces during operation of the wet-type rotor pump.

8. The wet-type rotor pump according to claim 7, further comprising:

a motor armature connected to said pump wheel; and a slit pot surrounding said motor armature such that said feed medium flows around said motor armature for cooling.

* * * * *